United States Patent [19]

Foti

[11] Patent Number: 4,733,411

[45] Date of Patent: Mar. 29, 1988

[54] DISPOSABLE BIB

[76] Inventor: Cynthia S. Foti, 3446 Harmony La., Spring Valley, Calif. 92077

[21] Appl. No.: 832,345

[22] Filed: Feb. 24, 1986

[51] Int. Cl.[4] ..... A41B 13/10

[52] U.S. Cl. ..... 2/49 R

[58] Field of Search ..... 2/49 R

[56] References Cited

U.S. PATENT DOCUMENTS

| | | | |
|---|---|---|---|
| 1,992,769 | 2/1935 | Post | 2/49 |
| 2,523,565 | 9/1950 | Gardner | 2/49 |
| 2,760,200 | 8/1956 | Shamyer | 2/49 |
| 2,859,446 | 11/1958 | Older | 2/52 |
| 4,569,086 | 2/1986 | Takefman | 2/49 |

*Primary Examiner*—Doris L. Troutman

*Attorney, Agent, or Firm*—Baker, Maxham & Jester

[57] ABSTRACT

An outer absorbent paper layer and an inner waterproof plastic layer, each configured to provide an apron and a yoke, are bonded together in overlapping relationship with adhesive and connected along their outer boundaries and neckline with over-lock stitching. The yoke is removably attached over one shoulder with an adhesive tab.

8 Claims, 4 Drawing Figures

FIG. 1
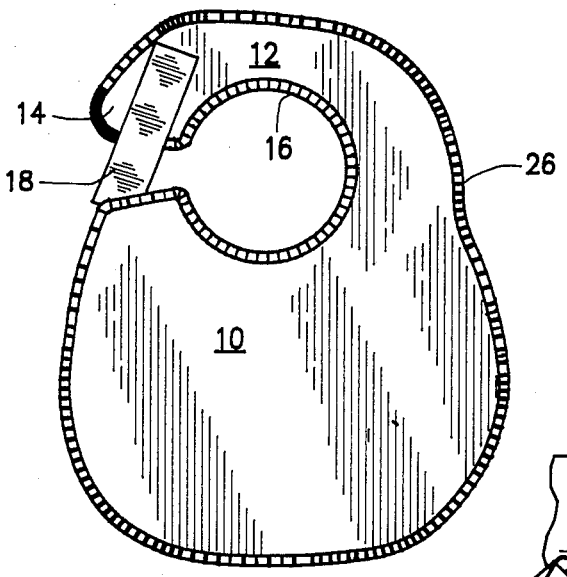
FIG. 2
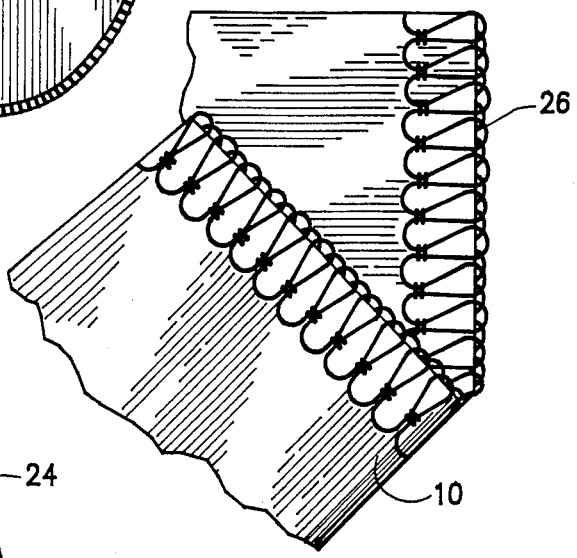
FIG. 3
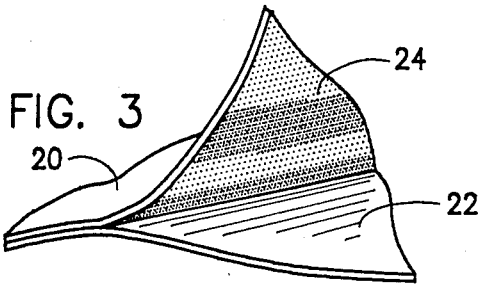
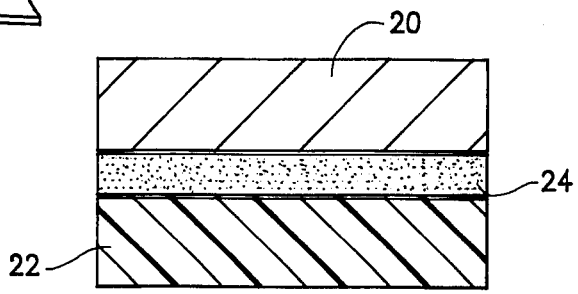
FIG. 4

DISPOSABLE BIB

BACKGROUND OF THE INVENTION

The present invention relates to protective garments, and more particularly, to an inexpensive, durable bib for infants, young children or infirmed persons.

Infants and young children frequently wear bibs to protect their regular clothing from saliva and vomit, as well as food and beverages that they spill in the process of eating. Unfortunately, certain feeble adults and handicapped persons must also utilize bibs.

Heretofore infant bibs have been made entirely of a fabric such as terry cloth, entirely of plastic, or by combining fabric with a waterproof plastic backing. These childrens' bibs have typically had strings, buttons, or metal snaps which are secured together behind the child's neck. This is often difficult to do when the child is sitting in a chair or asleep. Such bibs are normally washed and reused. Other bibs have been made entirely of paper so as to be disposable. These paper bibs have typically been used by adults in restaurants, hospitals, convalescent homes and dental offices. Paper bibs are not well suited for a child because they are readily torn and parts thereof may be swallowed. They also lack any waterproof backing for protecting the underlying clothing.

SUMMARY OF THE INVENTION

It is therefor the primary object of the present invention to provide an improved bib.

It is another object of the present invention to provide an inexpensive, durable bib suitable for convenient use and disposal.

It is another object of the present invention to provide a disposable bib that performs well in protecting underlying clothing of the wearer.

It is another object of the present invention to provide a disposable bib that can be used safely with infants.

It is another object of the present invention to provide a disposable bib that can be readily manufactured.

It is another object of the present invention to provide a disposable bib that is easily fastened.

It is another object of the present invention to provide a disposable bib that is comfortable to wear and does not unduly restrict movement.

It is another object of the present invention to provide a disposable bib that is visually attractive in configuration and finishing details and which may readily have logos and art work emblazoned thereon.

It is another object of the present invention to provide a disposable bib which is lightweight.

It is another object of the present invention to provide a disposable bib which is easily stored in large numbers.

According to the illustrated embodiment of the present invention an outer absorbent paper layer and an inner waterproof plastic layer, each configured to provide an apron and a yoke, are bonded together in overlapping relationship with adhesive and connected along their outer boundaries and neckline with over-lock stitching. The yoke is removably attached over one shoulder with an adhesive tab.

BRIEF DESCRIPTION OF THE DRAWINGS

FIG. 1 is a plan view illustrating a preferred embodiment of my disposable bib.

FIG. 2 is a greatly enlarged fragmentary view of a portion of the bib of FIG. 1 folded over to illustrate the over-lock stitching on the outer edge of the bib.

FIG. 3 is a fragmentary view illustrating the two-ply construction of the preferred embodiment of my disposable bib.

FIG. 4 is a diagrammatic sectional view illustrating the adhesive bonding which holds the plastic and paper layers of my preferred embodiment together.

DESCRIPTION OF THE PREFERRED EMBODIMENT

Referring to FIG. 1, the illustrated embodiment of my bib includes a generally pear-shaped apron 10 suitably dimensioned to overlie the person's chest and a generally C-shaped yoke 12 connected to the apron and suitably dimensioned to surround the person's neck. The yoke 12 extends from a first side of the apron and terminates in a free end 14 adjacent a second side of the apron. The apron 10 and yoke 12 define a round neck opening 16. The bib can be manufactured in four sizes, namely, extra-small, small, medium and large.

Referring still to FIG. 1, a segment of adhesively backed tape 18 provides a means for releasably securing the free end 14 of the yoke to the second side of the apron 10. The yoke can be connected and disconnected to the apron quickly and easily similarly to the way in which the sides of disposable diapers are connected and disconnected. Examples of such disposable diapers are sold under the trademarks HUGGIES and PAMPERS. Specifically, a first end of the tape segment 18 is permanently adhesively attached to the free end 14 of the yoke during manufacture of the bib. A second end of the tape segment extends from the bib and has a protective layer (not visible) which is peeled away by the user so that the second end can be adhesively attached to the second side of the apron 10 in overlapping fashion. In FIG. 1, the tape segment 16 is shown prior to connection to the apron. Once the protective layer is peeled away, the free end of the tape segment is pressed down on top of the apron, just as the other end of the tape segment was previously pressed down on top of the free end 14 of the yoke 12. The adhesive tape segment 18 provides a convenient alternative to tie strings, snaps, buttons and other fasteners. They also allow a degree of latitude in regard to the precise point of connection of the tape to provide a custom fit tailored to the size of the person's neck.

Referring still to FIG. 1, the overall shape of the bib is designed for comfort, simplicity, and functionality. The pear shape of the apron 10 allows the person full and unrestricted use of his or her arms. The lower portion of the apron becomes wider to ensure maximum protection against dampening or soiling of the underlying clothing. The round neckline 16 provides a comfortable fit. The yoke continues around the neck for attachment over the person's shoulder. It is much more convenient to attach or detach the yoke over the shoulder than behind the neck, as is the case with conventional bibs. Thus in the event that the infant falls asleep, my bib may easily be detached and removed without disturbing his or her sleep. Also, convalescent persons need not be subjected to the discomfort often received by the raising and or lowering of the head, neck and shoulder area which is often the case when using conventional bibs.

Referring to FIGS. 3 and 4, my bib has a two-ply construction including an upper absorbent paper layer 20 and a lower waterproof plastic layer 22 held together in overlapping relationship by non-toxic adhesive 24 and stitching 26 (FIG. 1). The stitching connects the paper and plastic layers around the outer boundaries of the apron and yoke and around the neckline. The upper and lower layers may be cut from rolls of suitable material to yield the shape of the apron and the yoke. Die cutting or other conventional means may be used to mass produce the paper and plastic apron/yoke pieces for subsequent joining.

The upper paper layer 20 preferably has high absorbency to accommodate drool, spillage, vomiting, etc. It is also preferably tear resistant, light weight, and soft to the touch. One suitable paper is sold under the trademark WYPALL by Scott Paper Company, Philadelphia, Pa. 19113. It consists of cellulose held together with a 100% natural latex bonding agent.

The lower plastic backing layer 22 provides a waterproof shield to protect the person's clothing against moisture and stains. It also provides additional strength to the bib to reduce the likelihood of an infant tearing off a portion of the bib and swallowing it. The plastic layer also results in a more comfortable fit. One suitable plastic material is commercially available from IRON CLAD, 5011 Argosey Avenue, Huntington Beach, Calif., 92649, and comprises a 0.84 ml linear low density polyethylene film with 3% Titanium Dioxide that gives it a white color.

The adhesive 24 (FIGS. 3 and 4) preferably holds the paper and plastic layers together over substantially their entire surfaces. This may be accomplished by spraying on a suitable adhesive over the entire area of one surface of one of the layers and then pressing the other layer over the same. The adhesive is preferably non-toxic since an infant or other wearer may put the bib in his or her mouth. One suitable spray-on adhesive is Textile Table Adhesive #492 commercially available from International Coatings Company, Inc., 13929 166th Street, Cerritos, Calif., 90701. It consists of synthetic rubber, resins and petroleum distillates. The solvents and petroleum ingredients evaporate and leave no harmful elements behind. The adhesive bond 24 serves to hold the paper and plastic layers 20 and 22 firmly together to facilitate the application of the stitching 26 about the outer boundaries of the apron and yoke and along the neckline 16. The adhesive bond also prevents puckering between the paper and plastic layers during the manufacturing process. The bond also adds to the integral strength of the bib and reduces the likelihood of the bib tearing apart during normal usage.

The combination of the paper, plastic and adhesive identified above results in the plastic layer assuming an appealing "orange peel" or slightly wrinkled texture which is not illustrated in the drawings. A picture, design, slogan, trademark or logo may be printed, silk-screened or otherwise formed on the paper layer using a suitable non-toxic color media. One suitable media is a no-lead, water based ink commercially available under the name "Textile Ink" from Delta Technical Coatings, Inc., 4357 North Rowland Ave., El Monte, Calif. 91731.

The stitching 26 (FIG. 1) holds the peripheral edges of the paper and plastic layers together, thereby providing added strength. Preferably the stitching is done with a colored thread to provide a more eye-appealing, finished product. The stitching also prevents raveling and separation of the paper and plastic layers and provides a soft border against the neck and arms. In order to accomplish these objectives it is preferable that the stitching be of the over-lock type illustrated in FIG. 2 which has multiple threads and extends around the edges of the paper and plastic layers.

Thus it will be understood that my bib has a unique design offering many advantages. It is inexpensive, lightweight, easily packaged and stored, and eliminates laundering. Also, my bib protects clothing, it is aesthetically appealing, it is easy to attach and remove, it is comfortable, and it is non-toxic.

Having illustrated and described a preferred embodiment of my bib in detail, it will be understood by those skilled in the art that my invention may be modified in arrangement and detail. Therefore, the protection afforded my invention should only be limited in accordance with the scope of the following claims and reasonable equivalents thereof.

I claim:

1. A bib, comprising:

a paper layer;

a plastic layer;

means for holding the paper and plastic layers together in overlapping relationship including stitching connecting an outer boundary of each of the layers and a quantity of a non-toxic adhesive adhering the paper layer to the plastic layer;

the paper and plastic layers being configured to provide an apron and a yoke, the yoke extending from one side of the apron and terminating in a free end adjacent a second side of the apron and being adapted for surrounding a person's neck when the apron generally overlies the person's chest; and a segment of an adhesively backed tape having a first end attached to the free end of the yoke and a second end extending from the free end of the yoke for overlapping attachment to the the second side of the apron substantially above the person's shoulder after the yoke has been placed around the person's neck.

2. A bib according to claim 1 wherein the means for holding the paper and plastic layers together further includes stitching connecting an inner boundary of each of the layers defining an opening for the person's neck.

3. A bib according to claim 1 wherein the means for holding the paper and plastic layers together further includes stitching around a pair of boundaries of the layers defining the free end of the yoke and the second side of the apron.

4. A bib according to claim 1 wherein the paper layer is made of cellulose and a a latex binder.

5. A bib according to claim 1 wherein the plastic layer is made of polyethylene film.

6. A bib according to claim 1 wherein the apron and yoke together have a pear-shaped configuration.

7. A bib according to claim 1 wherein the stitching is of the over-lock type.

8. A bib, comprising:

a pear-shaped upper absorbent layer made of cellulose and a latex binder;

a pear-shaped lower waterproof layer made of polyethylene;

means for holding the upper absorbent and lower waterproof layers together in overlapping alignment including first over-lock stitching connecting an outer boundary of each of the layers, second over-lock stitching connecting an inner boundary of each of the layers defining an opening for a person's neck, and a quantity of a non-toxic adhesive adhering the upper absorbent layer to the lower waterproof layer;

the upper absorbent and lower waterproof layers being configured so that their overlapping, aligned combination provides an apron and a yoke, the yoke extending from one side of the apron and terminating in a free end adjacent a second side of the apron and being adapted for surrounding a person's neck when the apron generally overlies the person's chest; and a segment of an adhesively backed tape having a first end attached to the free end of the yoke and a second end extending from the free end of the yoke for overlapping attachment to the second side of the apron substantially above the person's shoulder after the yoke has been placed around the person's neck.

* * * * *